US005097683A

United States Patent [19]

Schüler et al.

[11] Patent Number: 5,097,683

[45] Date of Patent: Mar. 24, 1992

[54] TOOL FOR STITCH FORMING MACHINES, PARTICULARLY KNITTING MACHINES

[75] Inventors: Bernhard Schüler, Sonnenbühl; Kurt Wiedenhöfer, Albstadt, both of Fed. Rep. of Germany

[73] Assignees: Theodor Groz & Söhne; Ernst Beckert Nadelfabrik Commandit-Gesellschaft, both of Albstadt-Ebingen, Fed. Rep. of Germany

[21] Appl. No.: 546,937

[22] Filed: Jul. 2, 1990

[30] Foreign Application Priority Data

Jun. 30, 1989 [DE] Fed. Rep. of Germany ..... 3921506

[51] Int. Cl.[5] ..... D04B 35/04

[52] U.S. Cl. ..... 66/121; 66/124

[58] Field of Search ..... 66/24, 121, 123, 124

[56] References Cited

U.S. PATENT DOCUMENTS

| | | | |
|---|---|---|---|
| 1,221,806 | 4/1917 | Scott | 66/124 X |
| 1,415,322 | 5/1922 | Egly | 66/124 |
| 3,977,217 | 8/1976 | Ross | 66/124 |
| 4,612,786 | 9/1986 | Perotti | 66/123 X |
| 4,646,542 | 3/1987 | Tenconi | 66/24 |

FOREIGN PATENT DOCUMENTS

| | | | |
|---|---|---|---|
| 124156 | 11/1984 | European Pat. Off. | 66/123 |
| 2238196 | 5/1974 | Fed. Rep. of Germany . | |
| 2151963 | 3/1973 | France . | |
| 592891 | 2/1978 | U.S.S.R. | 66/123 |

*Primary Examiner*—Wm. Carter Reynolds
*Attorney, Agent, or Firm*—Spencer & Frank

[57] ABSTRACT

A tool for a stitch forming machine which includes a bed and a plurality of guide grooves disposed in the bed, the tool including a shank slidably disposed in one of the guide grooves. The shank includes an end having a stitch forming device, and has a butt and at least two bends spaced from one another along a longitudinal direction of the shank. The bends are oriented toward the same side of the shank and are disposed in a region of the shank which, during sliding movement of the shank during operation of the knitting machine, remains within the guide groove.

13 Claims, 2 Drawing Sheets

TOOL FOR STITCH FORMING MACHINES, PARTICULARLY KNITTING MACHINES

CROSS-REFERENCE TO RELATED APPLICATION

The present disclosure relates to the subject matter disclosed in German Application No. P 39 21 506.7 of June 30th, 1989, the entire specification of which is incorporated herein by reference.

BACKGROUND OF THE INVENTION

The present invention relates to a tool for stitch forming machines, particularly knitting machines, the tool including a shank adapted to be inserted into a guide groove (trick) in a bed and provided with stitch forming means at least in the region of one end. The shank is bent transversely to its longitudinal direction and includes at least one butt.

Such tools are needles, particularly latch needles, compound needles, hooks, sinkers and similar components which are punched out of steel sheet (steel band) or are manufactured from steel wire and contribute to the forming of stitches. They are guided so as to be longitudinally displaceable in the guide grooves of the associated bed, with their longitudinal movement being controlled by cam elements which cooperate in a known manner with the needle butts.

Due to the continual development of new stitch forming machines having increased operating speeds, tools for these machines, for example the latch needles of small circular knitting machines, are not only subjected to greater mechanical stresses than encountered in earlier such machines but the speed with which the tools are moved back and forth is also increased to the same extent as the operating speed. For example, in knitting machines, an increased needle velocity results in greater shimmying movements of needles in guide grooves of the needle bed which in turn cause needle vibrations. This interferes with the proper and uniform sliding movement of the needles in the guide grooves of the needle bed and has an adverse effect on the quality of the merchandise produced.

At the same time, the vibrations caused by the shimmying movements generate transversely oriented bending vibrations at a stitch forming portion of the needle which projects from the needle bed such that the head of the needle, together with the hook and the latch, are deflected from a plane of symmetry of the needle to such an extent that the latch brushes against an adjacent transfer jack during a pivoting movement of the needle. When this occurs, irregularities appear in the merchandise produced. Further, this brushing of the needle against the adjacent transfer jack produces a unilaterally ground noucat or latch spoon having sharp edges which may damage the yarn during knitting, thereby making the needle unusable immediately.

A known measure for counteracting such shimmying of the needle in its guide groove in the needle bed is provision of a so-called friction bend in the needle shank. Such a friction bend is formed by laterally bending the shank at one location in a direction which is transverse to the longitudinal extent of the shank, such that the shank regions on either side of the friction bend are disposed at an obtuse angle relative to each another (as specified in DIN ISO 8119, Part 1, Page 28, No. 14). Due to this friction bend, when the shank is inserted into a guide groove of the needle bed, it is pressed laterally against a side wall of the guide groove with a certain elastic bias.

As disclosed, for example, in the introduction to the specification of German Auslegeschrift No. 2,225,834, which corresponds to U.S. Pat. No. 3,977,217, the basic problem of the above-mentioned prior art friction bend is that the bias created in this way is not sufficient to keep the needle shank lying against the side wall, as seen in the longitudinal direction of the needle, over the entire length of the portion of the needle disposed in the guide groove of the needle bed. This is illustrated in FIG. 4, showing a prior art needle lying in a guide groove 11 having a guide groove side wall 14. The prior art needle includes a shank 1' and a needle head 3', the shank 1' having a friction bend 17. The needle head 3' is separated from the guide groove side wall by a distance or separation S. During operation, the needle executes a longitudinal movement, during which the needle head 3' and the portion of the needle shank 1' following it are pushed out of the guide groove 11 of the needle bed. Due to the separation S in the position of the needle shown in FIG. 4, however, the longitudinal movement of the needle from the guide groove 11 causes the needle head 3' to perform an arcuate movement in a direction which is transverse to the longitudinal direction of the guide groove 11, i.e., in the down direction in FIG. 4. During this longitudinal movement of the needle, the bias with which the needle shank 1' is pressed against the associated the guide groove side wall 14 continuously changes. On the other hand, during this longitudinal movement of the needle, the needle head 3' moves toward the adjacent transfer jack so that, in the case of a fine gauge needle having a needle latch, the needle latch may engage with or rub against the adjacent transfer jack in an undesirable or improper manner.

In the German Auslegeschrift No. 2,225,834, in order to attempt to overcome the aforementioned problems, instead of providing the prior art friction bend, the shank itself is twisted about its longitudinal axis. According to this arrangement, only a section of the shank (not shown in FIG. 4) is twisted, and this twisted section is disposed in a region of the shank which remains in the guide groove 14 during the movement of the stitch forming tool. Due to the presence of this twisted section, the shank portion exiting from the guide groove 11 is held approximately in the middle of the guide groove, i.e. at a distance from the side walls of the guide groove, during the back and forth movement of the tool. However, the section remaining in the interior of the guide groove 11 is not held in the middle of the guide groove 11. Due to the lack of a lateral support of the shank portions lying in the front region of the guide groove, needle vibrations cannot be avoided during operation. Aside from this, in the twisted section there is only a linear contact between the side walls of the guide groove 11 and the twisted shaft portions which are urged under an elastic bias against the side walls of the guide groove 11. This linear contact extends essentially in the longitudinal direction of the guide groove 11 between the shank and the side walls of the corresponding guide groove 11. However, due to the elastic bias between the shank and the side walls of the guide groove 11 and the relatively small contact area therebetween, such linear contact causes relatively high pressures between the shank and the side walls of the guide groove 11, and consequentlY causes relatively greater wear. After relatively short periods of operation, the contacting edges are worn off so that lateral play develops between the side walls of the corresponding guide groove 11 and the shank, thereby causing vibrations and shimmying of the needle.

Finally, latch needles for knitting machines are disclosed in German Patent No. 2,238,196, in which a needle is shown having a needle shank which is corrugated several times starting at the butt of the needle and extending over its entire length so that its flank contacts the guide channel or groove cheeks in a manner which changes several times. The thus created serpentine course of the needle shank is intended to prevent a linear propagation of control shock pulses emanating from the butt and directed toward the needle head and thus to prevent or reduce the occurrence of premature hook breaks. Although in this latch needle the alternating flank contact in principle results in a bilateral guidance of the needle shank along both guide channel side walls or guide groove cheeks, close tolerances are required for the corrugations and the guide channels or guide grooves of the needle bed which cannot always be provided in practice.

SUMMARY OF THE INVENTION

It is an object of the present invention to provide a tool for stitch forming machines, particularly knitting machines, whose shank is configured and adapted to be guided in such a manner that, during movement of the tool within a guide groove during operation of the stitch forming machine, the shank is longitudinally guided without play.

The above and other objects are accomplished according to the invention in that a tool is provided for a stitch forming machine which includes a bed and a plurality of guide grooves disposed in the bed, the tool including a shank adapted to be slidably disposed in one of the guide grooves, the shank including an end having a stitch forming means, a butt, and at least two bends spaced from one another along a longitudinal direction of the shank, the bends being oriented toward the same side of the shank and being disposed in a region of the shank which, during sliding movement of the shank during operation of the knitting machine, remains within the guide groove.

The above-mentioned bends formed in the shank of the tool ensure that a major portion of the shank length which, during operational movements of the tool, remains within the guide groove of the needle bed lies continuously against one side wall of the guide groove. This creates a uniform bias which eliminates any lateral play on the part of the shank in the guide groove, independently of any tolerances in shank thickness and tolerances in the width of the guide groove, so that no vibrations occur in the tool during operation. The tool shank is thereby guided properly and slides quietly in the needle bed. The shank portion projecting from the needle bed, when moved, remains in a plane determined by the adjacent laterally supporting guide groove side wall, and does not perform any movement directed transversely thereto which would lead to brushing against adjacent tools or to dynamically caused breakage.

The bends are advantageously disposed in the region of the tool between a butt of the tool and the means for forming stitches. For example, in a latch needle, the bends are disposed between a butt end of the needle and the needle head. Particularly in connection with long needles, it may also be advisable to provide the bends between two butts or behind one butt approximately in the region of a so-called back shank region.

In general, the bends encompass substantially identically sized obtuse angles. Independently of the needle construction, however, constructions are also conceivable in which at least two bends encompass different sized obtuse angles.

The invention will be described in greater detail below with reference to an embodiment which is illustrated in the drawings.

DETAILED DESCRIPTION OF THE PREFERRED EMBODIMENT

Figures 1, 2:
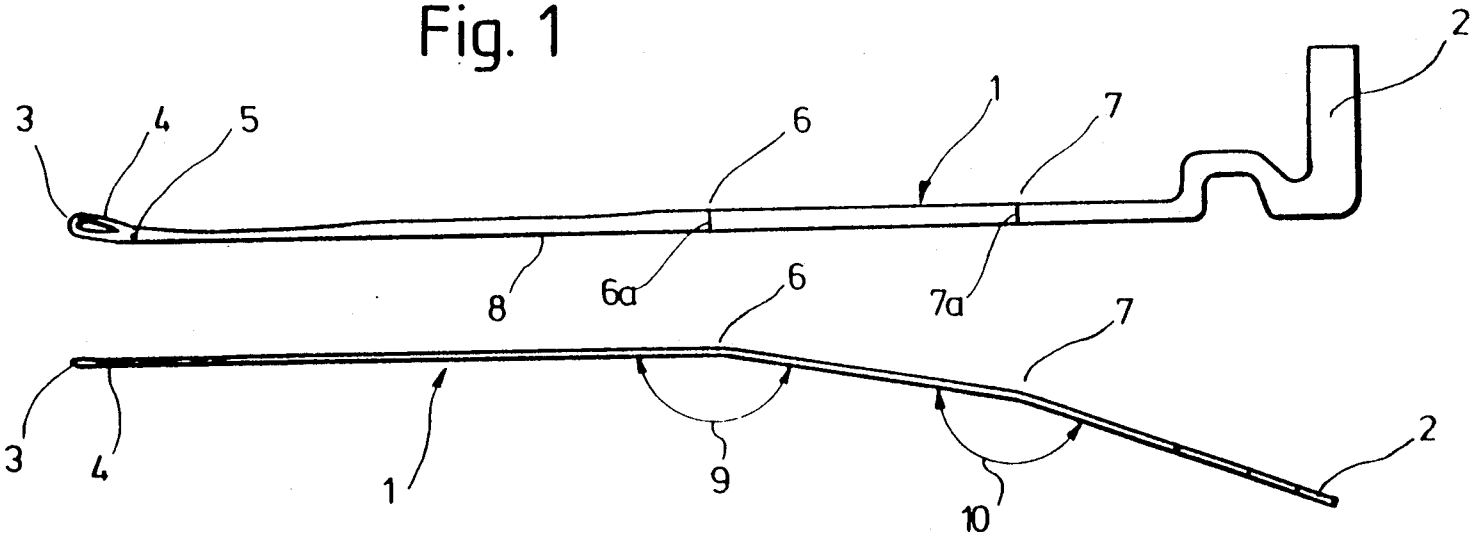
FIG. 1 is a side elevational view of a tool according to the invention, in which the tool is a latch needle.
FIG. 2 is a top elevational view of the latch needle of FIG. 1.

A latch needle made from steel sheet material is shown in FIGS. 1 and 2, and includes a shank 1 which has a needle back edge 8, a butt 2 at one end and, at the other end, a needle head 3. A needle latch 4 is mounted in a latch slot on the needle shank 1, so as to be pivotable about a latch axis 5. The needle latch 4 cooperates in a known manner with the needle head 3.

In the region between the needle head 3 and the butt 2, two spaced-apart bends 6 and 7 are disposed in the shank 1 and are oriented transversely to the longitudinal extent of the shank 1. The bends 6 and 7 are both oriented in the same direction (toward the bottom as viewed in FIG. 2), and are formed at bend lines **6*a* and 7*a* which extend at a right angle to the longitudinal extent of the shank 1, as well as to a plane containing the needle back edge 8**.

The two bends 6 and 7 encompass the same size obtuse angles 9 and 10 which, in the illustrated embodiment, are each about 170°. The selected magnitude of the obtuse angles 9 and 10 depends, among other considerations, on the width of the guide grooves or channels 11 (shown in FIG. 3) of a needle bed in which the latch needles operate, on the thickness of the shank 1, and on the structural conditions of the machine.

Figure 3:
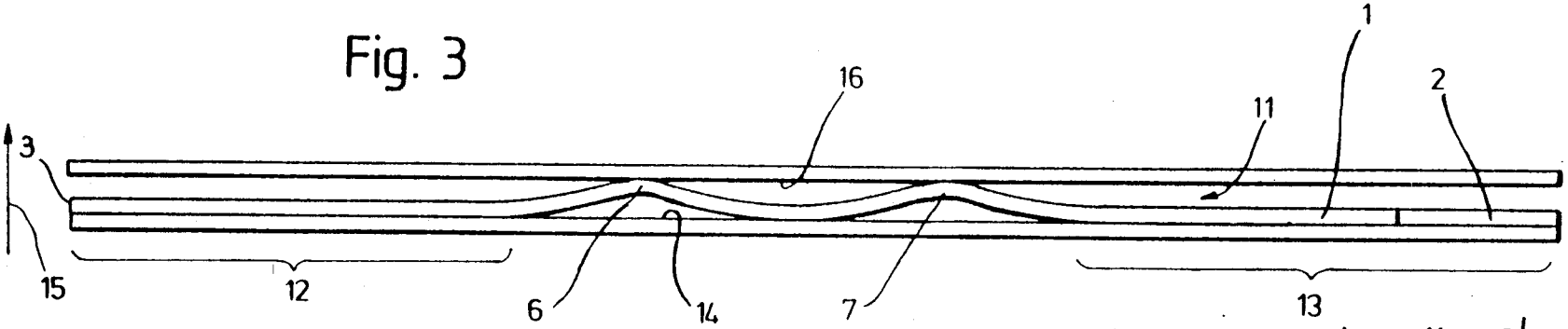
FIG. 3 is a schematic, side elevational view of the latch needle of FIG. 1 inserted in a guide groove of a needle bed.

FIG. 3 shows one of the guide grooves 11 bounded by parallel guide groove side walls 14 and 16 in a needle bed (not shown), each of the guide grooves 11 of the needle bed has a corresponding latch needle disposed therein which is of the type shown in FIGS. 1 and 2. Due to the presence of the two bends 6 and 7, whose spacing from one another depends on the structural conditions of the needle and the needle bed, the regions of the shank 1 laterally adjacent the bends 6 and 7 are pressed flush against and are biased toward the respective guide groove side wall 14. In a circular knitting machine with a rotating needle cylinder, the side wall 14 of the corresponding one of the guide grooves 11, when seen in a direction of rotation which is indicated by an arrow 15 in FIG. 3, follows behind the other one of the guide groove side walls 16 against which the shank 1 is supported in the region of the two bends 6 and 7.

The shank 1 includes a shank region 12, as shown in FIG. 3, which is adjacent the exit from the guide groove 11, the exit being at the left end of the guide groove 11 in this figure. This shank region 12 is pressed elastically over its length against the guide groove side wall 14. The guide groove side wall 14 is disposed on a side of the guide groove 11 which is opposite to the direction of movement of the needle cylinder (not shown) indicated by the arrow 15 so that the shank region 12 of the shank 1 always retains an accurately defined position relative to the guide groove 11 independently of the operational back and forth movement of the latch needle in the guide groove 11. The needle, during its operational movements, travels in a direction which is parallel to the longitudinal direction of the guide groove 11, i.e., left and right as view in FIG. 3. The portion of the shank 1 which projects from the guide groove 11 during operation does not undergo a transverse movement relative to the direction of operational movement of the needle. Due to this very precisely defined positioning of the needle head 3 during operation of the needle, it is possible in circular knitting machines equipped with such latch needles to also set a transfer jack ring in such a manner that a precisely predetermined, sufficiently large distance exists between the needle head 3 and an adjacent one of the transfer jacks, so as to prevent the needle latch 3 from brushing against the adjacent one of the transfer jacks due to an undesired pivoting movement of the needle head 3 relative to the direction of operation of the needle parallel to the guide groove 11.

Figure 4:
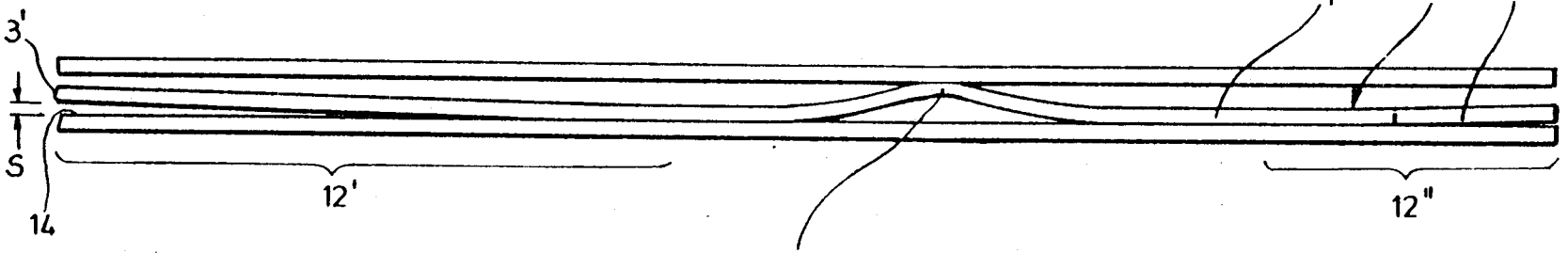
PRIOR ART Fig. 4
FIG. 4 is a schematic, side elevational view of a prior art type of latch needle having a single bend in its shank, inserted into a guide groove of a needle bed.

The basic differences between the novel latch needle described above in connection with FIGS. 1 to 3 and a latch needle whose shank is equipped in a known manner with only a single transversely extending bend 17 is evident from a comparison of FIGS. 3 and 4. In the prior art needle according to FIG. 4 described in the foregoing, the bend 17 causes the shank 1' to be elastically deformed toward the center of the guide groove 11 in a region 12' which is adjacent to the exit end of the guide groove 11 and to be elastically deformed in a shank region 12''(in contrast shank region 13 in FIG. 3). As a result, the needle head 3' lifts away by the separation or distance S from the adjacent guide groove side wall 14. The consequence this lateral deformation caused by the bias in bend 17 in the shank portion 12' which, during operational movement of the needle, projects from the guide groove 11, is that the needle head 3', independently of the back and forth movement of the latch needle in the guide groove 11, executes a known type of back and forth transverse movement relative to the longitudinal axis of the guide groove 11 which, particularly when a fine gauge needle is used and under unfavorable conditions, leads to brushing of the needle latch (not shown in FIG. 4) against adjacent transfer jacks.

In dependence on the length of the needle shank 1, the number of control butts provided on the needle shank 1, and the construction of the needle bed, more than two bends 6, 7 may additionally be provided whose spacing in the longitudinal direction of the needle may also vary. For example, it is also conceivable to provide such additional bends on both sides of the needle butt 2 or in the region behind the needle butt 2, that is in the region of the socalled back shank.

In the described latch needle, the needle head 3 and the needle latch 4 constitute means for forming stitches. However, the present invention can also be used for other stitch forming tools, for example sinkers which have a shank that is displaceably guided in corresponding guide grooves or channels of a bed and whose means for forming stitches are constituted, for example, by the known loop forming sinkers, throats and the like. In such other stitch forming tools, however, the bends corresponding to bends 6 and 7 of FIGS. 1-3 are disposed in that section of shank 1 which, during the back and forth movement of the tool in the associated one of the guide grooves 11 during operation, remains within that guide groove 11 so that the region of the shank 1 remaining between the bed exit and the first bend 6 always remains pressed flush against its respective guide groove side wall 14.

It will be understood that the above description of the present invention is susceptible to various modifications, changes and adaptations, and the same are intended to be comprehended within the meaning and range of equivalents of the appended claims.

What is claimed is:

1. A tool for a stitch forming machine which includes a bed and a plurality of pairs of spaced-apart side walls defining guide groves disposed in the bed, one of the pairs of side walls being first and second side walls and one of the guide grooves being a predetermined guide groove between the first and second side walls, said tool comprising:

a resilient shank adapted to be slidably disposed in the predetermined guide grooves while contacting both of said first and second side walls, said shank including an end having stitch forming means, said shank having a butt and at least two bends spaced from one another along a longitudinal direction of said shank, said at least two bends being oriented toward the same side of said shank and being disposed in a region of said shank, said region, during sliding movement of said shank during operation of the stitch forming machine, remaining within the guide groove, said shank contacting said first side wall at each of said bends and being spaced-apart from said first side wall between adjacent bends, said shank contacting said second side wall at a shank region adjacent said stitch forming means and at a shank region adjacent said butt.

2. A tool as defined in claim 1, wherein said at least two bends are disposed in a region between said butt and said stitch forming means.

3. A tool as defined in claim 1, wherein said at least two bends respectively enclose substantially identically sized obtuse angles.

4. A tool as defined in claim 1, wherein said at least two bends each enclose respective obtuse angles, said respective obtuse angles being of different angular sizes.

5. A tool for a knitting machine which includes a bed and a plurality of guide grooves disposed in the bed, each guide groove respectively having a guide groove wall, comprising:

a shank adapted to be slidably disposed in one of the guide grooves, said shank being resiliently deformable and having an end having stitch forming means, said shank having a butt and at least two bends spaced from one another along a longitudinal direction of said shank, said at least two bends being oriented toward the same side of said shank and being disposed in a predetermined region of said shank, said predetermined region, during sliding movement of said shank during operation of the knitting machine, remaining within said one of the guide grooves, said shank being resiliently biased by said bends so as to be in contact with the respective guide groove wall of said one of the said guide grooves only at said bends.

6. A tool as defined claim 5, wherein said at least two bends are disposed in a region between said butt and said stitch forming means.

7. A tool as defined in claim 5, wherein said bends respectively enclose substantially identically sized obtuse angles.

8. A tool as defined in claim 5, wherein said bends each enclose respective obtuse angles, said respective obtuse angles being of different angular sizes.

9. A tool for a knitting machine which includes a bed and a plurality of guide grooves disposed in the bed, each guide groove having a respective pair of guide groove walls, comprising:

a unitary and resiliently deformable shank which is adapted to be slidably disposed in one of the guide grooves, the shank having a first end region with a needle head, a second end region with a butt, and an intermediate region which extends from the first end region to the second end region, the intermediate region of the shank having at least two bends which are spaced apart from one another along a longitudinal direction of said shank and which are oriented toward the same side of the shank, each of the bends remaining within said one of the guide grooves during sliding movement of the shank during operation of the knitting machine, the shank being resiliently biased by said bends so as to be in contact with one guide groove wall of the respective pair of guide groove walls only at said bends and so as to be in contact with the other guide groove wall of the respective pair of guide groove walls at the first and second end regions of the shank; and a needle latch pivotably mounted on the shank at the first end region of the thereof.

10. A tool as defined in claim 9, wherein the shank is additionally in contact with the other guide groove wall of the respective pair of guide groove walls between adjacent bends.

11. A tool as defined in claim 9, wherein the intermediate region of the shank has a plurality of straight segments before the shank is resiliently deformed, the bends being provided between straight segments and enclosing substantially identically sized obtuse angles.

12. A tool as defined in claim 9, wherein the number of bends in he shank is two, and wherein the shank has first, second, and third straight segments before the shank is resiliently deformed, the first straight segment extending from the first end region of the shank to one of the two bends, the second straight segment extending from the second end region of the shank to the other of the two bends, and the third straight segment extending between the two bends.

13. A tool as defined in claim 12, wherein the angle between the first and third straight segments is approximately 170° and the angle between the second and third straight segments is approximately 170°.

* * * * *